US005992635A

United States Patent [19]

Walters

[11] Patent Number: 5,992,635

[45] **Date of Patent: *Nov. 30, 1999**

[54] PRESSURE VACUUM RELEASE HERMETIC VALVE FOR FLEXIBLE PACKAGES

[75] Inventor: William J. Walters, Wescosville, Pa.

[73] Assignee: Fres-co System USA, Inc., Telford, Pa.

[ * ] Notice: This patent is subject to a terminal disclaimer.

[21] Appl. No.: 09/134,301

[22] Filed: Aug. 14, 1998

Related U.S. Application Data

[63] Continuation-in-part of application No. 08/826,700, Apr. 7, 1997, Pat. No. 5,893,461.

[51] Int. Cl.[6] ..... B65D 81/20; B65D 90/34; B60C 29/00; F16K 17/28

[52] U.S. Cl. ..... 206/524.8; 383/100; 220/89.1; 137/493

[58] Field of Search ..... 206/524.8, 320, 206/497, 811, 522; 383/100, 103; 220/89.1, 89.2; 229/125.04, 125.42, 120, 214; 137/493, 493.1

[56] References Cited

U.S. PATENT DOCUMENTS

| | | | |
|---|---|---|---|
| 3,151,626 | 10/1964 | Everett | 137/493 |
| 3,159,175 | 10/1964 | MacMillan | 137/493 |
| 3,595,467 | 7/1971 | Goglio . | |
| 3,799,427 | 3/1974 | Goglio . | |
| 3,941,149 | 3/1976 | Mittleman | 137/493.1 |
| 4,420,015 | 12/1983 | Blaser . | |
| 4,576,285 | 3/1986 | Goglio . | |
| 4,653,661 | 3/1987 | Buchner et al. | 383/103 |
| 4,705,174 | 11/1987 | Goglio . | |
| 4,727,706 | 3/1988 | Beer . | |
| 4,890,637 | 1/1990 | Lamparter | 383/103 |
| 4,913,561 | 4/1990 | Beer . | |
| 4,922,954 | 5/1990 | Blomquist et al. | 137/493 |
| 5,059,036 | 10/1991 | Richison et al. | 383/103 |
| 5,246,114 | 9/1993 | Underwood | 206/524.8 |
| 5,249,598 | 10/1993 | Schmidt | 137/493.1 |
| 5,388,910 | 2/1995 | Koyanagi | 383/100 |
| 5,396,925 | 3/1995 | Poli | 137/493 |
| 5,399,022 | 3/1995 | Sheets | 383/103 |
| 5,553,942 | 9/1996 | Domke et al. | 383/103 |

*Primary Examiner*—Paul T. Sewell
*Assistant Examiner*—Anthony Stashick
*Attorney, Agent, or Firm*—Caesar, Rivise, Bernstein, Cohen & Pokotilow, Ltd.

[57] ABSTRACT

A flexible, gussetted package having an interior for holding some particulate material product, e.g., food stuffs, under vacuum, and which includes a mouth to be opened to provide access to the contents of the package. The package is formed of a flexible material and includes a front panel, a rear panel, a pair of opposed side gussets and a pressure equalizing valve. The valve includes a displaceable slitted-aperture disk located on a valve seat and is arranged to operate in a first mode of operation wherein any gasses within the package are allowed to vent to the exterior of the package, by passing through the interface between the disk and the valve seat while the ambient atmosphere is precluded from entering into the interior of the package. The valve also operates in a second, transitory, mode wherein the slitted aperture in the disk allows a small amount of the ambient atmosphere to gain ingress into the interior so that the package's walls give a smooth appearance. The valve then enters into its third mode of operation wherein the disk engages the valve seat to isolates the interior of the package from the exterior. A layer of silicone oil is provided on the disk to facilitate operation of the valve.

11 Claims, 3 Drawing Sheets

FIG. 6
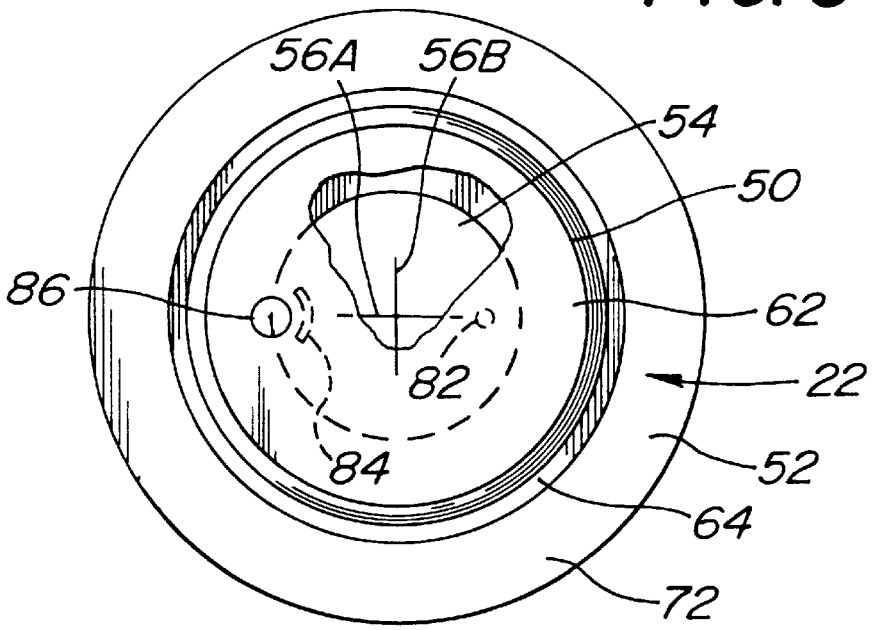
FIG. 7
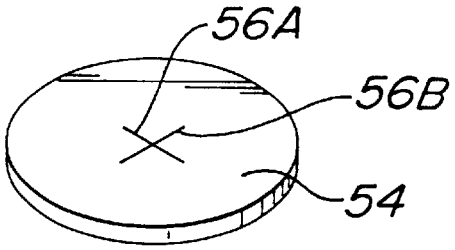
FIG. 8
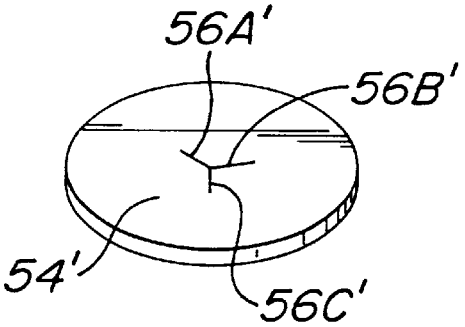
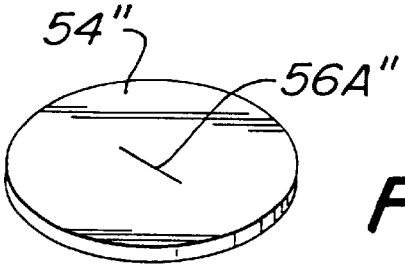
FIG. 9

PRESSURE VACUUM RELEASE HERMETIC VALVE FOR FLEXIBLE PACKAGES

This application is a Continuation-In-Part of my earlier application Ser. No. 08/826,700 filed on Apr. 7, 1997, now U.S. Pat. No. 5,893,461 patented Apr. 13, 1999, entitled "Pressure Vacuum Release Hermetic Valve For Flexible Package," assigned to the same assignee as this invention and whose disclosure is incorporated by reference herein.

BACKGROUND OF THE INVENTION

This invention relates generally to flexible packages, and more particularly to flexible packages for holding products in a hermetically sealed condition, e.g., isolated from the ambient atmosphere, while allowing a controlled amount of air into the package in order to provide a smooth aesthetically appearing surface.

Various types of flexible packages for holding particulate materials under vacuum therein have been disclosed in the patent literature and are commercially available today. Examples of packages for holding ground or whole bean coffee are found in the following U.S. Pat. Nos. 4,576,285, 4,705,174, and 4,913,561.

The major advantages of flexible packaging, as compared to relatively rigid packaging, e.g., cartons, are that until the flexible package is filled it takes up very little volume, and after it is emptied of its contents it readily collapses, thereby reducing its volume to approximately that of the unfilled package. The former characteristic is a significant advantage insofar as storage is concerned, while the latter characteristic is a significant advantage from the standpoint of disposability. One common type of flexible package for holding goods under vacuum until the package is opened is the so-called "gussetted" package or bag. Typically such a package is formed from a web of flexible stock material, e.g., polyethylene, polyester, polypropylene, metal foil, and combinations thereof in single or multiple plies, into a tubular body, having a face panel, a back panel, and a pair of gussetted sides. Each gussetted side is formed by a pair of gusset sections and a central fold edge interposed between a pair of outer fold edges. The lower end of the bag is commonly permanently sealed, e.g., heat sealed, along a line extending transversely across the width of the bag close to its bottom edge. The top of the bag is commonly sealed transversely across the entire width of the bag in a number of ways to maintain the contents under vacuum until the bag is opened. Such action is frequently accomplished via a readily openable mouth, which when opened provides access to the contents of the bag.

One-way degassing valves are typically included in flexible packages to enable any gasses produced by the particulate material within the package to exit from the package, while preventing air from entering into the package through the valve. Examples of such one-way degassing valves are shown in U.S. Pat. Nos. 3,595,467, 3,799,427 and 4,420,015.

One drawback of many commercially available vacuum sealed flexible packages is the fact that when the package is filled, sealed and evacuated the material forming the walls of the package intimately engages the particulate material disposed therein, thereby resulting in an uneven, bumpy, pebbly or otherwise less than satisfactory aesthetic appearance. In U.S. Pat. No. 4,727,706, which is assigned to the same assignee as this invention, there is disclosed a package which exhibits the advantages of hermetically sealed flexible packaging, yet provides a smooth aesthetically pleasing appearance. That package basically comprises an inner bag and an outer bag. The inner bag is formed of a flexible sheet material which is resistant to the passage of gas therethrough. The outer bag is also formed of a flexible sheet material. The outer bag is secured to the inner bag by adhesive areas which define passageways therebetween through which air from the ambient atmosphere may flow to enter the space between the outer and inner bags. The inner bag is arranged to be filled with a particulate material and then the bag vacuumized and sealed, whereupon the walls of the inner bag closely conform to the surface of the particulate material. The air space between the inner and outer bag enables the outer bag to have a smooth aesthetically pleasing appearance even though the inner bag may be in close conformance to the contents of the package.

It is not an uncommon practice by producers of other types of hermetically sealed flexible packages to perforate the package to release trapped air for stacking and shipping. This practice allows the air within the package to be expelled from the package to prevent the package from "pillowing." As will be appreciated by those skilled in the art, such pillowing is undesirable, particularly with relatively large packages, e.g., approximately twenty five pounds or more, since it can adversely affect the package's ability to be stacked in a stable manner, one on top of another. The disadvantage with perforating the hermetically sealed package is that it reduces, if not destroys, the effectiveness of the hermetic seal.

For many applications, e.g., packaging of agricultural chemicals or other industrial particulate materials, the hermetically sealed package can exhibit a pebbly or unsmooth appearance resulting from its evacuation and concomitant close conformance to its particulate contents, yet still be acceptable, since appearance of the packaging is typically not a factor in industrial applications. Where, however, relatively large packages of particulate materials are intended for personal or home use, e.g., large bags of dry pet foods, the appearance of the package becomes important insofar as marketability is concerned.

Accordingly, a need exists for packaging which is simple in construction, relatively low in costs, and which provides the advantages of conventional hermetically sealed packaging, while providing an aesthetically pleasing smooth external appearance.

OBJECTS OF THE INVENTION

Accordingly, it is a general object of this invention to provide a flexible package which addresses the needs of the prior art.

It is a further object of this invention to provide a flexible package for particulate materials formed of a single wall of flexible material and which can be hermetically sealed, yet which exhibits a smooth exterior appearance.

It is a further object of this invention to provide a hermetically sealed flexible package for particulate materials which includes a valve to permit the package to reach an equilibrium state in which the pressure within the package is equal to the pressure outside the package so that the package exhibits a smooth wall appearance.

It is a further object of this invention to provide a hermetically gussetted flexible package which is simple in construction, relatively low in cost, which can be manufactured easily and which provides an aesthetically pleasing appearance.

It is a further object of this invention to provide a hermetically sealed gussetted flexible package for particulate materials which includes a valve to enable release of gas from the interior of the package so it can be readily stacked and to permit some small quantity of air to gain ingress into the packages when it is no longer stacked to provide a smooth, aesthetically pleasing exterior surface, while still maintaining the hermetic seal.

SUMMARY OF THE INVENTION

A package, e.g., a gussetted bag, having an interior for holding a particulate material, e.g., dry pet food, coffee, chemicals, etc. The bag is formed of a flexible material and comprises a front panel and a rear panel, which between them define an openable mouth for the package. The package also includes a pressure/vacuum release hermetic degassing valve in one of its panels. The package is arranged to be hermetically sealed to isolate its contents from the ambient surroundings. The valve is arranged to operate in three modes. In one mode the valve allows any gasses within the package to gain egress to the exterior of the package, while precluding the ambient atmosphere from gaining ingress into the interior of the package. When the valve is in its second mode of operation it allows a small amount of the surrounding ambient atmosphere to gain ingress into the package's interior until the pressure within the interior of the package is equal to the pressure of the ambient surroundings. At that time the walls of the flexible material making up the package move out of tight conformance with the particulate material in the package to exhibit a smooth, aesthetically pleasing appearance. When this occurs the valve is operating in its third or equilibrium mode, of operation. In this mode further ambient atmosphere is precluded from entering the package. However, any gasses produced by the contents of the package can vent out of the valve to the ambient surroundings.

In accordance with one preferred aspect of the invention the valve includes a displaceable member, e.g., a planar resilient-material disk or substantially flat member, arranged to be disposed on a valve seat, yet to be lifted therefrom when the pressure within the package exceeds the pressure outside the package, e.g., when in the first mode. The displaceable member includes at least one slit which is arranged to flex open when the valve is in its second mode of operation to enable a small amount of air to enter the package through the slit.

A layer of a viscous fluid, e.g., silicone oil, is provided on the displaceable member, e.g., the disk, so that the fluid is located at the interface of the disk and the valve seat, and preferrably also at the slitted aperture. The presence of this fluid prevents any penetration of air through the interface and through the slitted aperture when the valve is in the third mode of operation.

DESCRIPTION OF THE DRAWING

FIG. 6 is an enlarged plan view of the valve of the package of FIG. 1, with a portion broken away, and which view is taken along line 6—6 of FIG. 3; and FIGS. 7–9 are respective isometric views of three different embodiments of a disk component of the valve.

DETAILED DESCRIPTION OF THE PREFERRED EMBODIMENT

Figure 1:
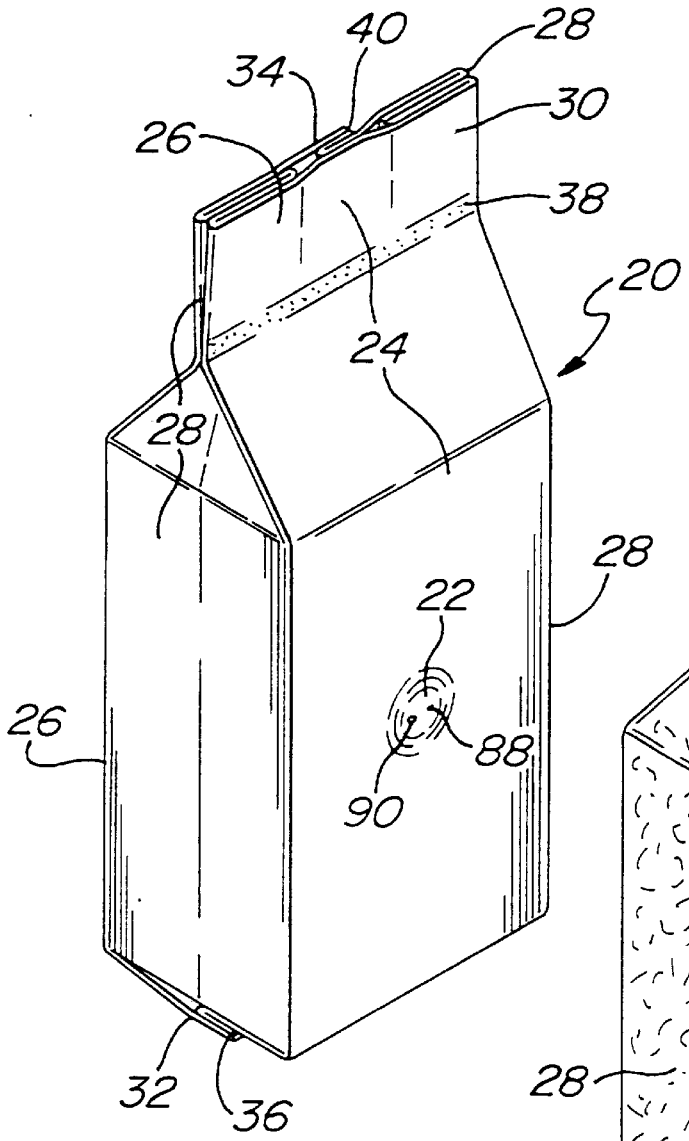
FIG. 1 is an isometric view of a package constructed in accordance with the invention, shown after it has been filled and sealed has reached its static equilibrium state or mode wherein the surface of the package is smooth.

Referring to FIG. 1, there is shown at 20 in FIG. 1 a flexible package constructed in accordance with this invention. The package basically comprises a gussetted bag having a pressure-equalizing, one-way degassing valve 22 mounted in its front wall (as will be described later). The bag 20 is arranged to hold any particulate material 10 (FIGS. 3–5), e.g., coffee beans, ground coffee, dry pet food, chemicals, etc. Moreover, the bag is particularly suitable for holding large amounts of such materials, e.g., in excess of twenty five pounds, although it can be used for packaging small amounts of such materials.

The bag 20 is formed of a web of any conventional, flexible material and basically comprises a front wall or panel 24, a rear wall or panel 26, a pair of identical gussetted sides 28, a top end portion 30, and a bottom end portion 32. The top end portion 30 of the package terminates in a top marginal edge 34. In a similar manner the bottom end portion 32 of terminates in a bottom marginal edge 36. The degassing valve 22 is mounted in the front panel 24, although it can be located in the rear panel as well, and is in communication with the interior of the bag. The valve enables gasses which may be produced by the material(s) (e.g., coffee) contained within it after it is hermetically sealed to vent to the ambient air, without air gaining ingress to the bag's interior, except for a small amount of pressure equalizing air which is permitted to enter the package in accordance with this invention. This small amount of air is enabled to enter the package during a transient mode of operation until the package reaches its equilibrium state, at which time the walls of the bag move out of close conformance to the package's particulate material contents so that the walls exhibit a smooth exterior, as will be described later.

The front panel 24, rear panel 26, and the two gussetted sides 28 of the bag are all integral portions of a single sheet or web of the flexible material, of single or multiple ply or layers, which has been folded and seamed to form a tubular body. Particularly useful flexible material for the bag 20 are commercially available from Fres-Co System U.S.A., Inc., of Telford Pa., the assignee of this invention.

In a preferred embodiment the package has a peelable mouth formed by a peelable seal line 38 between the abutting walls to enable the walls of the package at the mouth to be readily peeled a part to open the mouth.

As is conventional, the rear panel 26 of the package 20 includes a fin 40 which extends longitudinally along the back of the package from the top edge to the bottom edge. The fin 40 is located approximately midway between the gussetted sides 28 and is formed by portions of the web material contiguous with the vertical marginal edges of the sheet or web which are brought into engagement with each other and are secured to one another via any conventional sealing technique, such as heat sealing or welding. The fin is generally folded down so it lays substantially flush with the rear wall 26 of the bag.

The bag 20 is arranged to be initially hermetically sealed closed along the peelable seal line 38 after it has been filled and vacuumized. The seal line 38 serves to isolate the contents 10 of the package 20 from the ambient atmosphere once it is hermetically sealed.

The lower or bottom end 32 of the bag is sealed closed along a transverse, permanent seam line (not shown) closely adjacent the bottom edge 36. The permanent seam line is formed using any conventional sealing technique, such as that used for the vertical seamed fin 38.

Figure 2:
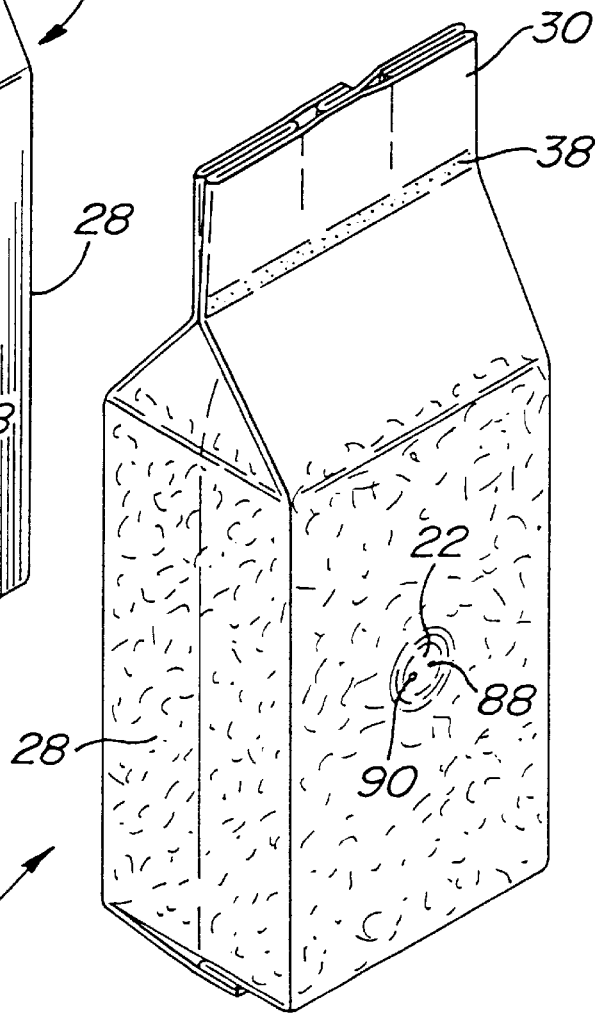
FIG. 2 is an isometric view similar to FIG. 1 but showing the package, exhibiting its pebbled appearance (due to its evacuation) and shown before reaching its static equilibrium state.

When the bag 20 is filled, vacuumized, and sealed its particulate contents 10, will be kept isolated from the ambient air by the seal line 38. In particular, when the bag is initially vacuumized, the higher pressure outside of the package, as compared to the lower pressure within the package, causes the material forming the package's walls 24, 26 and 28 to closely conform to the particulate material 10 within the package. This results in a somewhat, pebbly, uneven, rough or generally less-than-optimum aesthetic appearance, such as shown in FIG. 2. The package can, however, be readily stacked in multiples in a stable manner, since there will be no air or other gasses entrapped within the package which would otherwise cause an unstable "pillowed" condition. Moreover, the weight of the stacked packages, plus the close conformance between the valve on one package and the abutting wall of the abutting package will effectively cover the valve to help maintain the hermetical seal. Any gasses which are produced by the material 10 within the package are never the less able to vent to the exterior in a normal manner (as will be described later). At this time the valve is operating in its "pressure release mode." Further details of the operation of the valve in this mode will be described later.

When the package 20 is removed from the stack, the "freeing" of it enables the valve 20 to assume its transient "pressure relief state." In this transient state a small amount of air is permitted to gain ingress into the package over an extended period of time, until the valve reaches its "static equilibrium state." In this latter state the walls of the package will have moved out of intimate engagement with the particulate materials and thereby produce a smooth exterior appearance which is aesthetically pleasing. Once the static equilibrium state has been reached the valve remains in this state and no further air can enter the package through it. If, however, any gasses are produced within the package by its contents 10, this action will tend to raise the internal pressure within the package so that it exceeds the external pressure, whereupon the valve assumes its pressure release mode to allow the internal gasses to vent, while precluding the ingress of air into the package.

The construction and operation of the valve 22 will now be discussed with reference to FIGS. 3–9.

Figure 3:
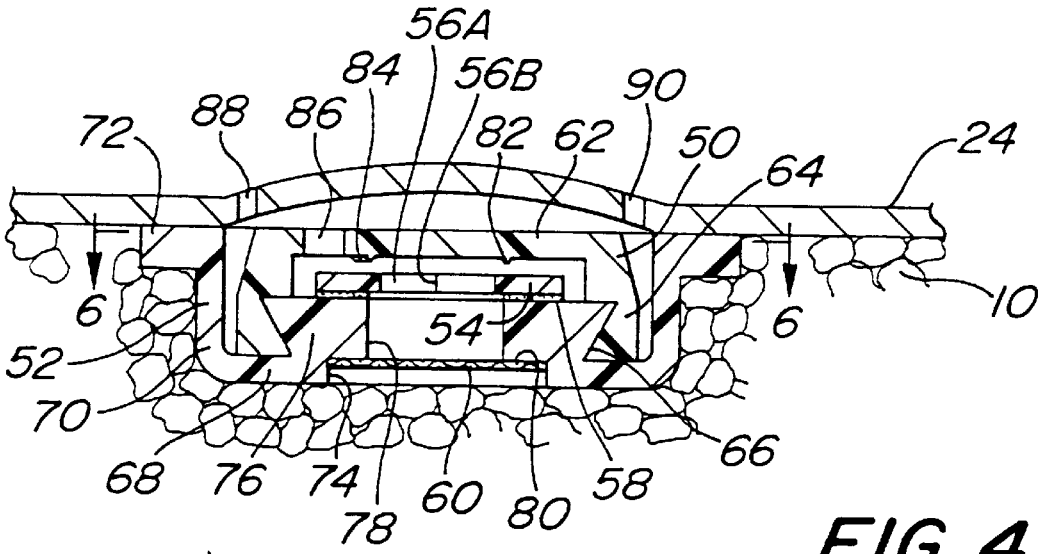
FIG. 3 is an enlarged horizontal sectional view, taken through the valve of the package of FIG. 1 during its static equilibrium mode shown in FIG. 1.

As can be seen in FIG. 3, the pressure/vacuum release hermetic valve 22 basically comprises a cap 50, a plate or base member 52, an elastomeric, e.g., rubber, disk 54 having at least one slit 56 therein, a thin layer of oil 58, e.g., silicone oil, and a filter member 60. Preferably the valve is constructed somewhat like those of U.S. Pat. Nos. 3,595,467 and 3,799,427, whose disclosures are incorporated by reference herein, but whose resilient disk is modified in accordance with this invention to include the heretofore identified slit(s) 56, for reasons which will become apparent later.

As best seen in FIGS. 3–6 the cap member 50 is a generally cylindrical member having a planar circular top wall 62 and a circular slightly conical side wall 64 terminating at its bottom in an under-cut annular groove 66. The base member 52 is a generally cup-shaped member having a planar circular bottom wall 68 and a circular sidewall 70 terminating at its top in an annular flange 72. The bottom wall 68 includes a central opening or hole 74 having an annular flange 76 extending thereabout and projecting up from the interior surface of the bottom wall 68. The annular flange 76 is under-cut on its exterior surface to be received in and mate with the under-cut groove 66 in the cap member 50. A central opening or hole 78 is provided in the flange 76 and is smaller than the hole 74 to form a ledge 80 on which the filter member 60 is disposed and secured, e.g., glued.

The undersurface of the top wall 62 of the cap member includes a pair of projections or nibs 82 and 84 extending slightly downward. The projection 82 is of circular shape as shown in FIG. 6, while the projection 84 is of arcuate shape. These projections serve as "disk contact points" to space and hold the disk member off of the inner surface of the top wall of the cap member. The top wall of the cap member includes a small hole 86 in it immediately adjacent the arcuate nib 84.

The disk 54 member is a planar circular member having at least one slit therein. In FIG. 7 there is shown a disk member 54 having a pair of slits 56A and 56B which are of the same length and disposed perpendicular to each other to form an X-shaped configuration. The slits extend through the entire thickness of the disk and form between them four generally triangular displaceable areas or fingers. In FIG. 8 there is shown a disk member 54' having three slits 56A', 56B' and 56C' which are disposed at 120° from one another to form a generally Y-shaped configuration, with three generally triangular displaceable areas or fingers disposed therebetween. In FIG. 9 there is shown an embodiment of a disk 54" having a single slit 56A". This slit forms a pair of displaceable areas on either side of the slit.

The disk member 54 (or 54' or 54") is disposed on the top surface of the annular flange 76 so that its slit(s), e.g., 56A and 56B, are disposed over the central openings 78 and 74 in the base member. A thin layer of the silicone oil 58 is interposed between the disk member 54 and the surface on which it is disposed. That surface forms the "valve seat" of the valve 22. The cap member is arranged to be snap fit on the base member to form a hollow interior, with the disk member 54 and oil layer 58 being disposed therein.

The flange 72 serves as the means to secure the valve 22 to the front wall 24 of the package 20. To that end the valve's flange is welded or heat sealed about its entire top surface to the inner surface of the flexible material making up the front wall 24 of the bag 20. A pair of small apertures or holes 88 and 90 are provided in the front wall 24 of the package within the bounds of the seal line extending around the flange 72. Alternatively, a large opening can be provided in the wall 24 to make up the entire area within the bounds of the flange 72.

In accordance with a preferred embodiment of this invention the cap member 50 and base member 52 are injection molded of polyethylene. The disk member 54 is stamped from a sheet of polyisobutylene rubber. The filter 60 comprises a circular disk or sheet of non-woven, heat-sealable filter paper.

The valve 22 is assembled by placing a drop of silicone oil 58 on the top surface of the flange 76 of the base member 52 and inserting the rubber disk 54 on top of the silicon oil such that the oil forms a seal between the base member and the disk. The cap member 50 is then placed, e.g., snap fit, onto the base member. The filter paper 60 is sealed to underside of the ledge 80 of the base member. The valve 22 is mounted in the front panel of the package 20 via a flange 72 on the interior side of a flexible package so that the exterior side of the valve is positioned toward the exterior side of the package 20 and the interior side of the valve is positioned toward the interior of the package. The small holes 86 and 90 (or other cuts, not shown) are placed in the front panel 24 of the package within the perimeter of the sealed flange 72 so that air or other gasses can pass through the package 20 and out through the valve 22 during its various modes of operation as will be described later.

Two mechanisms are relied upon for the valve 22 to operate. In particular, the elastic nature of the rubber disk 54 enables the area portions of the disk between adjacent or contiguous slits to flex independently of other portions of disk between or adjacent other contiguous slits. Moreover, when the rubber disk 54 is flexed during operation of the valve, a gap is created at the interface of the slits and through which outside air can pass. The elastic nature of the rubber disk also serves to effect the automatic reclosure of the slits and to keep the slits closed and impermeable to oxygen, moisture, and odors when the disk is unflexed and flat. The viscous nature of the silicone oil serves to create a seal between the valve seat of the base member and the rubber disk which is impermeable to atmospheric gasses (e.g. oxygen), moisture, and odors.

The filter paper 60 is disposed so that it covers the orifice or hole 78 in the base member in order to protect the valve mechanism from being contaminated by particles 10 of the product in the package.

As mentioned earlier, and as will now be described in detail, the valve 22 has three modes of operation.

Figure 5:
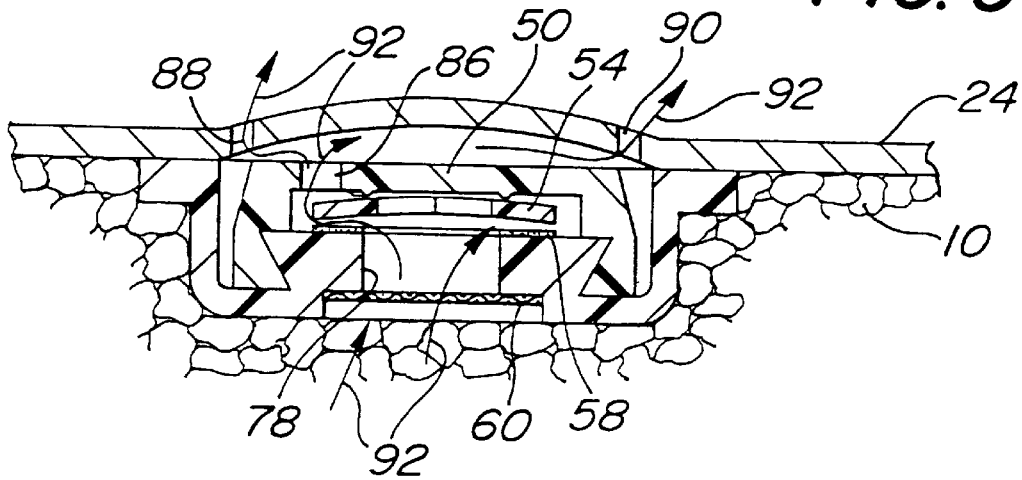
FIG. 5 is an enlarged sectional view, similar to FIGS. 3 and 4, but showing the valve in normal pressure relief state to allow gases within the package to vent the exterior, without permitting the ingress of air from the exterior.

The first mode of operation of the valve 22, is shown in FIG. 5 and is referred to as "pressure release mode" This mode of operation occurs when a pressure differential is applied to the valve such that the pressure in the interior of the flexible package is higher than the pressure on the exterior of the package. In this situation, the valve functions to equalize the interior and exterior pressures by allowing the higher internal pressure to break the elastic bond between the valve seat (top surface of flange 76), the silicone oil 58, and the rubber disk 54, allowing air to escape in the direction of arrows 92 through the base member's orifice 78, past the disk 54 and out of the valve through the hole 86 in the cap member. From there the air escapes through the holes 88 and 90 in the front panel 24 of the bag. Additional air may also escape through the slits in the disk which, when presented with a pressure differential, becomes concave in the direction toward the lower pressure, thus flexing the disk toward the exterior of the package which opens the slits and allows air to pass through the base member's orifice, through the flexed slits, through the hole 86 in the cap member 50, and out of the package 20.

Once sufficient air has been released out of the package to equalize the internal and external pressures, the disk 54 automatically returns to it normally flat, unflexed state, shown in FIG. 3, whereupon the slits are closed, i.e., in abutment with each other. The surface tension of the silicone oil 58 reseals the bond between the valve seat, i.e., top surface of flange 76 of the base member 52, and the disk 54. Thus, the valve 22 stops operating in the "pressure release" mode and begins operating in the "static equilibrium mode".

Figure 4:
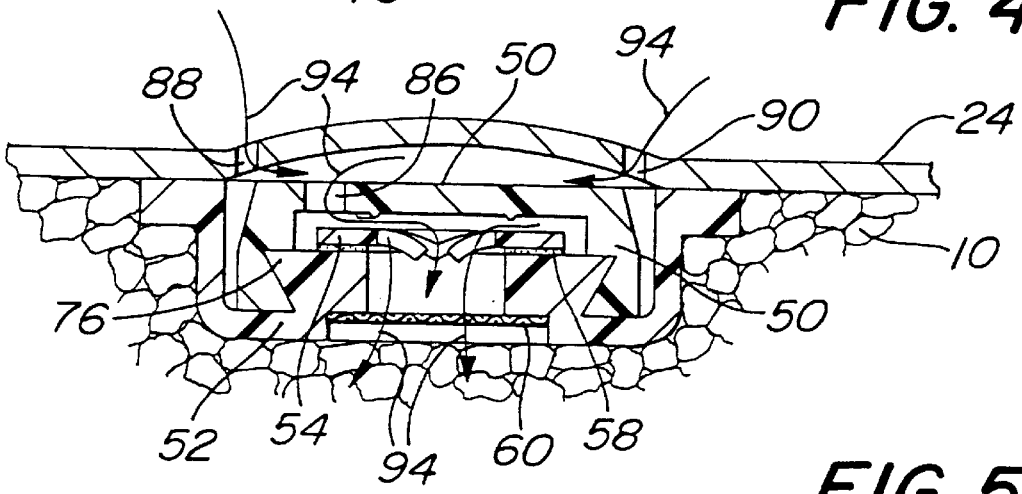
FIG. 4 is an enlarged horizontal sectional view, like that of FIG. 3, but showing the valve during its vacuum release mode, such as occurs when the package is removed from a stack of like packages and allowed to reach its static equilibrium state.

The second mode of operation is shown in FIG. 4 and is referred to as the "vacuum release mode." This mode of operation occurs when a pressure differential is applied to the valve such that the pressure in the interior of the flexible package is lower than the pressure on the exterior of the package. In this situation, the valve functions to equalize the interior and exterior pressures by allowing the disk 54 to become concave in the direction toward the lower pressure, thus, flexing the rubber disk toward the interior of the package. This action has the effect of opening the slits in the disk and allowing air to pass in the direction of arrows 94 through the apertures 88 and 90 in the front wall of the bag, through the hole 86 in the cap member, through the flexed slits, through the base member orifice 78, and into the interior of the package 22. Once sufficient air has been released into the package to equalize the internal and external package pressures, the valve stops operating in the vacuum release mode and begins operating in the third or "static equilibrium" mode.

The "static equilibrium mode" of operation is shown in FIG. 3 and occurs when the interior package pressure and exterior package pressure are equal. In this situation the rubber disk 54 remains sealed to the valve seat by the viscous nature of the silicone oil 58. In particular, the equal pressures maintain the disk in a flat, unflexed position, thus keeping the slits closed and impermeable to external, atmospheric gasses (e.g. Oxygen), moisture, or odors. In this mode, the walls of the package are smooth, as shown in FIG. 1. In accordance with one preferred embodiment of this invention the entire undersurface of the disk 54, i.e., the side of the disk closest to the valve seat, is completely covered with the silicone oil 58 so that the oil is also located at the slitted aperture. The presence of the silicone oil at the slitted aperture, e.g., on the entire undersurface of the disk, prevents any penetration of air through the disk's slits, thereby ensuring a proper hermetic seal for effective static equilibrium mode operation. This feature is of considerable importance when the package is used to hold oxygen-sensitive products, such as food stuffs, since even a small amount of air penetration into the package can result in spoilage.

As should be appreciated by those skilled in the art the subject invention provides a valve which allows a flexible package to be completely and hermetically sealed in order to protect the package's content against external gasses, e.g. atmospheric oxygen, moisture and odors during the large majority of time when internal and external package pressures are at equilibrium. Moreover, the valve provides a viable means for releasing entrapped air in the package so that it can be stacked and transported with similarly constructed packages, effectively and economically. Thus, the subject invention enables the creation of a soft, easy to handle, well shaped, aesthetically pleasing, and more durable package than the prior art by enabling the vacuum therein to be released during shipment.

Without further elaboration the foregoing will so fully illustrate my invention that others may, by applying current or future knowledge, adopt the same for use under various conditions of service.

I claim:

1. A package having an interior for holding a particulate material therein, said package being formed of a flexible material and comprising a front panel, a rear panel, and a pressure equalizing valve, said package having an interior, said front and rear panels being connected to each other, said valve being coupled to one of said panels and in communication with the interior of said package and in communication with the exterior of said package, said package being formed of a material suitable for being hermetically sealed with the particulate material being located within the interior of said package, said valve comprising a flexible displaceable substantially flat member, a valve seat, and a viscous fluid, said substantially flat member having a peripheral edge and a slitted aperture, said slitted aperture having marginal edges normally in engagement with each other to prevent the passage of a gas therethrough, said peripheral edge of said substantially flat member being disposed on said valve seat, with said viscous fluid interposed between said substantially flat member and said valve seat and also being located at said slitted aperture, said valve having a first mode of operation wherein said substantially flat member is deflected so that its marginal peripheral edge moves away from said valve seat to allow any gas within said package to pass thereby to gain egress to the exterior of said package, while said valve precludes the ambient atmosphere at the exterior of said package from gaining ingress into said interior, said valve also having a second mode of operation wherein said marginal edges of said slitted aperture of said substantially flat member separate from engagement from each other to allow a small amount of the ambient atmosphere at the exterior of said package to gain ingress into said interior through said slitted aperture, said valve also having a third mode of operation wherein said substantially flat member is undeflected to isolate said interior of said package from said exterior.

2. The package of claim 1 wherein said viscous fluid covers the entire surface of said substantially flat member contiguous with said valve seat.

3. The package of claim 2 wherein said fluid comprises silicone oil.

4. The package of claim 1 wherein said front and rear panels exhibit a smooth appearance when said valve is in said third mode of operation.

5. The package of claim 1 additionally comprising a filter to preclude the particulate material within said package from gaining ingress into said valve.

6. The package of claim 5 wherein said filter comprises filter paper.

7. A pressure equalizing valve for use with a flexible package holding a particulate material, the package being formed of a flexible material and comprising a front panel and a rear panel defining an interior in which the particulate material is disposed, said valve being arranged to be coupled to one of said panels and in communication with the interior of the package and in communication with the exterior of the package, the package being formed of a material suitable for being hermetically sealed with the particulate material located within the interior of the package, said valve comprising a flexible displaceable substantially flat member, a valve seat, and a viscous fluid, said substantially flat member having a peripheral edge and a slitted aperture, said slitted aperture having marginal edges normally in engagement with each other to prevent the passage of a gas therethrough, said peripheral edge of said substantially flat member being disposed on said valve seat, with said viscous fluid interposed between said substantially flat member and said valve seat and also being located at said slitted aperture, said valve having a first mode of operation wherein said substantially flat member is deflected so that its marginal peripheral edge moves away from said valve seat to allow any gas within the package to pass thereby to gain egress to the exterior of the package, while said valve precludes the ambient atmosphere at the exterior of the package from gaining ingress into the interior of the package, said valve also having a second mode of operation wherein said marginal edges of said slitted aperture of said substantially flat member separate from engagement from each other to allow a small amount of the ambient atmosphere at the exterior of the package to gain ingress into the interior through said slitted aperture, said valve also having a third mode of operation wherein said substantially flat member is undeflected to isolate the interior of the package from the exterior.

8. The valve of claim 7 wherein said viscous fluid covers the entire surface of said substantially flat member contiguous with said valve seat.

9. The valve of claim 8 wherein said fluid comprises silicone oil.

10. The valve of claim 7 additionally comprising a filter to preclude the particulate material within the package from gaining ingress into said valve.

11. The valve of claim 10 wherein said filter comprises filter paper.

* * * * *